US005334064A

United States Patent [19]

Ketterman et al.

[11] Patent Number: 5,334,064

[45] Date of Patent: Aug. 2, 1994

[54] LIFE RAFT STORAGE AND INFLATION SYSTEM

[75] Inventors: Kenneth L. Ketterman, Hampton; Raymond M. Kinne, Newport News, both of Va.

[73] Assignee: Hampton Rubber Company, Hampton, Va.

[21] Appl. No.: 26,741

[22] Filed: Mar. 5, 1993

[51] Int. Cl.[5] ..... B63C 9/22

[52] U.S. Cl. ..... 441/42; 138/125; 285/12; 285/247; 441/41

[58] Field of Search ..... 285/12, 276, 246, 247; 441/40–42; 138/110, 104, 125

[56] References Cited

U.S. PATENT DOCUMENTS

| | | | |
|---|---|---|---|
| 2,264,321 | 12/1941 | Manson | 441/40 X |
| 3,165,763 | 1/1965 | Gaylord | 441/41 |
| 3,177,016 | 4/1965 | Holmgren | 285/247 |
| 3,604,461 | 9/1971 | Matthews | 138/125 X |
| 4,362,517 | 12/1982 | Martin | 441/42 X |
| 4,905,735 | 3/1990 | Akiyoshi | 138/125 X |
| 5,154,653 | 10/1992 | Ketterman et al. | 440/84 |

FOREIGN PATENT DOCUMENTS

| | | | |
|---|---|---|---|
| 0739338 | 7/1966 | Canada | 285/247 |
| 0151017 | 8/1985 | European Pat. Off. | 285/247 |

*Primary Examiner*—Sherman Basinger

*Attorney, Agent, or Firm*—Griffin Butler Whisenhunt & Kurtossy

[57] ABSTRACT

A life raft storage and inflation assembly, or system (12) of a type having a deflated life raft (22) stored in a separable canister (14) includes a hose assembly (34, 34') which can be broken down for coupling a selectively activated nozzle of a compressed-gas cylinder (24, 24') to an inlet cock (32, 32') of the deflated life raft. The hose assembly is comprised of a thermo-plastic hose (36); two brass sockets (38) which thread onto an outer surface of the hose; and two coupling fittings, a male life raft coupling fitting and a female cylinder coupling fitting. Each of these coupling fittings has a threaded nipple (52) on one end. These nipples are screwed through ends (48) of the sockets into the interior of the hose. Couplings at the other ends of these coupling fittings are designed differently. A female, or cylinder, coupling (60) of the female coupling fitting has female threads (82) that mate with a male nipple on the gas cylinder. A male, or raft, coupling (62) of the male hose coupling fitting has a male threaded end that screws into a life raft coupling. The female coupling that fits on the cylinder has both internal and external coupling seals (70, 89) thereon to couple with both newer and older types of cylinder nipples (90, 88) which are attached thereto with of a swivel nut (76) held to the cylinder coupling by a retainer pin (78).

2 Claims, 2 Drawing Sheets

LIFE RAFT STORAGE AND INFLATION SYSTEM

BACKGROUND OF THE INVENTION

This invention relates broadly to systems for storing and inflating life rafts and more particularly to hoses for extending between pressurized vessels and inflatable life rafts in such systems.

Some life raft storage systems are comprised of clamshell canisters designed to hold, for example, 24-man life rafts with provisions for survival at sea in an event of an emergency. Such life rafts are inflated by means of compressed-air cylinders which are also encased in the clamshell canisters. Compressed air is released from the cylinders into the rafts when lanyards, that are respectively attached to valves of the cylinders, are pulled. In a prior-art example, as is disclosed in U.S. Pat. No. 5,154,653 to Ketterman and Kinne for example, such a lanyard is attached to an inner-end portion of a 100-foot coiled rope, or rope bundle, which is encased in a "bung-plug" assembly located at one end of the clamshell canister, with an outer-end portion of the coiled rope being attached to a tie cleat on a boat. When an emergency occurs, for example when a boat on which a clamshell canister is mounted is sinking, the clamshell canister is thrown overboard along with the enclosed life raft and one or more compressed-air cylinders. The outer-end portion of the coiled rope is affixed to the boat. As the clamshell canister falls downwardly, toward the sea, the coiled rope is pulled out of the clamshell canister until the clamshell canister travels 100 feet from the tie cleat to which its outer-end portion is attached. At this point, the rope is placed under tension, and the lanyard is pulled, thereby opening the valve on the cylinder containing the compressed air to inflate the raft in the clamshell canister. As the raft inflates, it applies outwardly directed force on the clamshell canister, which separates top and bottom halves of the clamshell canister. This pressure on the top and bottom halves of the clamshell canister separates them and releases the life raft ready for use.

In recent years, two compressed-air cylinders have been included in the canisters so that the life rafts are more evenly inflated. In this regard, the nozzle of each of the cylinders is attached, via a hose assembly, to a separate inlet coupling that is fabricated into the side of the life raft. To satisfy space requirements within the canisters, the life rafts and compressed-air cylinders are stored in particular manners, with hoses therefrom extending to inlet couplings at two different locations on the life raft. It is necessary that these hoses withstand a great deal of internal pressure and that they be durable under adverse conditions. In this regard, these hoses must withstand pressure impulses of up to 6000 psi and pressures of up to 3000 PSI on a steady basis. In the past, such hose assemblies have been constructed of teflon or wire reinforced hose with a braided stainless steel cover and coupling fittings that are affixed to the ends of the hoses. In this respect, each of the coupling fittings on prior-art hoses have been comprised of a nipple which extends into the interior of the hose and a ferrule and collar that are affixed to the outer surface of the hose. At a gas-cylinder end of the hose, the fitting has been made as one piece with a cylinder-hose coupling having a female swivel nut mounted thereon by means of a circular retaining pin. As the swivel nut is turned, the nipple on the cylinder is pulled into engagement with the seat on the cylinder-hose coupling to form a metal-to-metal seal therewith. In order to prevent the metal-braid hose from damaging the inflatable life raft, a protective sleeve is shrunk about the outer surface thereof to cover most of the ferrules and all of the metallic braid.

A major disadvantage of this prior-art hose assembly used for life raft storage and inflation systems is that it is unduly expensive to construct. Thus, it is an object of this invention to provide a hose assembly for a life raft storage and inflation system which can be constructed less expensively.

A related disadvantage of the above-described hose assembly for life raft and storage systems is that its hose, ferrules, nipples, and couplings cannot be disassembled and therefore cannot be replaced individually. Thus, if one of these elements becomes defective, it is necessary to totally replace the hose assembly, even though the other elements thereof may still operate properly. Thus, it is an object of this invention to provide a life raft storage and inflation system that has a hose assembly with various parts that can be individually replaced and which can be repaired without replacing the entire assembly.

Another difficulty with prior-art hose assemblies for life raft storage and inflation systems is that they require undue amounts of metal-to-metal contact, which, in turn, promotes corrosion. For this reason, it has been necessary to replace the entire prior-art assemblies approximately every four years. The labor involved and the cost of the hoses makes this a very expensive procedure. Thus, it is a further object of this invention to provide a hose assembly for life raft storage and inflation systems which need not be replaced as often, and which can be refurbished without total replacement thereof.

SUMMARY

According to principles of this invention, a life raft storage system includes a hose assembly that incorporates a synthetic, fiber-reinforced hose, two threaded brass sockets, and two different removable end fittings. One fitting includes a male coupling, while the other includes a female coupling. That is, each fitting has a male threaded brass nipple at one end, while one has male coupling threads at its opposite end and the other has female coupling threads at its opposite end. The sockets are screwed onto opposite ends of the hose. A large end of each socket extends beyond its end of the hose and has smaller-diameter female threads. One of the respective brass nipples is screwed through this threaded end of the socket into an internal surface of the hose itself. Thus, the hose wall is clamped between the nipple and the socket to form a seal. The nipples are made as one piece with their respective couplings. The female coupling is mated to a nipple on the compressed-air cylinder nozzle. The male coupling at the other end of the hose attaches to a female inlet of a deflated life raft. The female coupling that attaches to the nipple on the cylinder nozzle has a swivel nut mounted thereon and defines first and second coupling seats for mating with either of different first and second cylinder nipples that are engaged by the swivel nut.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
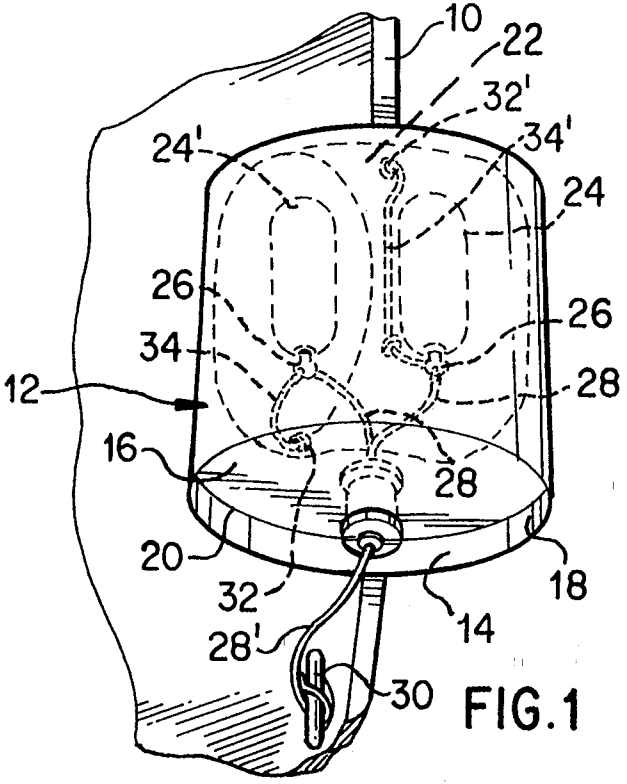
FIG. 1 is an isometric view of a portion of a boat, or ship, having a clamshell canister system of this invention mounted thereon with a life raft, compressed-air cylinders and hose assemblies mounted therein.

A boat, or ship, 10 has a life raft assembly 12 mounted thereon including a clamshell canister 14 having a top half 16 and a bottom half 18 joined at an edge interface 20, an inflatable 24-man raft 22, two compressed-gas (such as air) cylinders 24 and 24', each including a valve nozzle 26, and two lanyards 28. In this regard, the lanyards 28 are attached to a rope 28' which, in turn, is tied to a tie cleat 30 on the ship. Each of the valve nozzles 26 is coupled with an inlet cock 32, 32' of the life raft 22 by means of a hose assembly 34, 34'. In this regard, the hose assemblies 34 and 34' are identical in structure although one hose may be longer than the other because of space requirements and necessary positioning demands.

Figure 2:
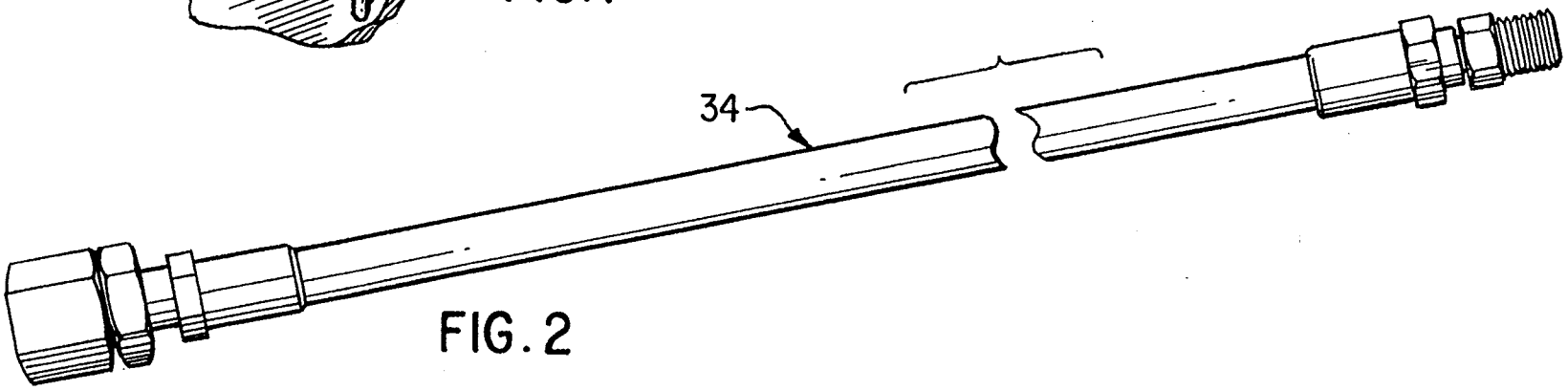
FIG. 2 is a side view of a hose assembly of this invention.
Figures 3, 4:
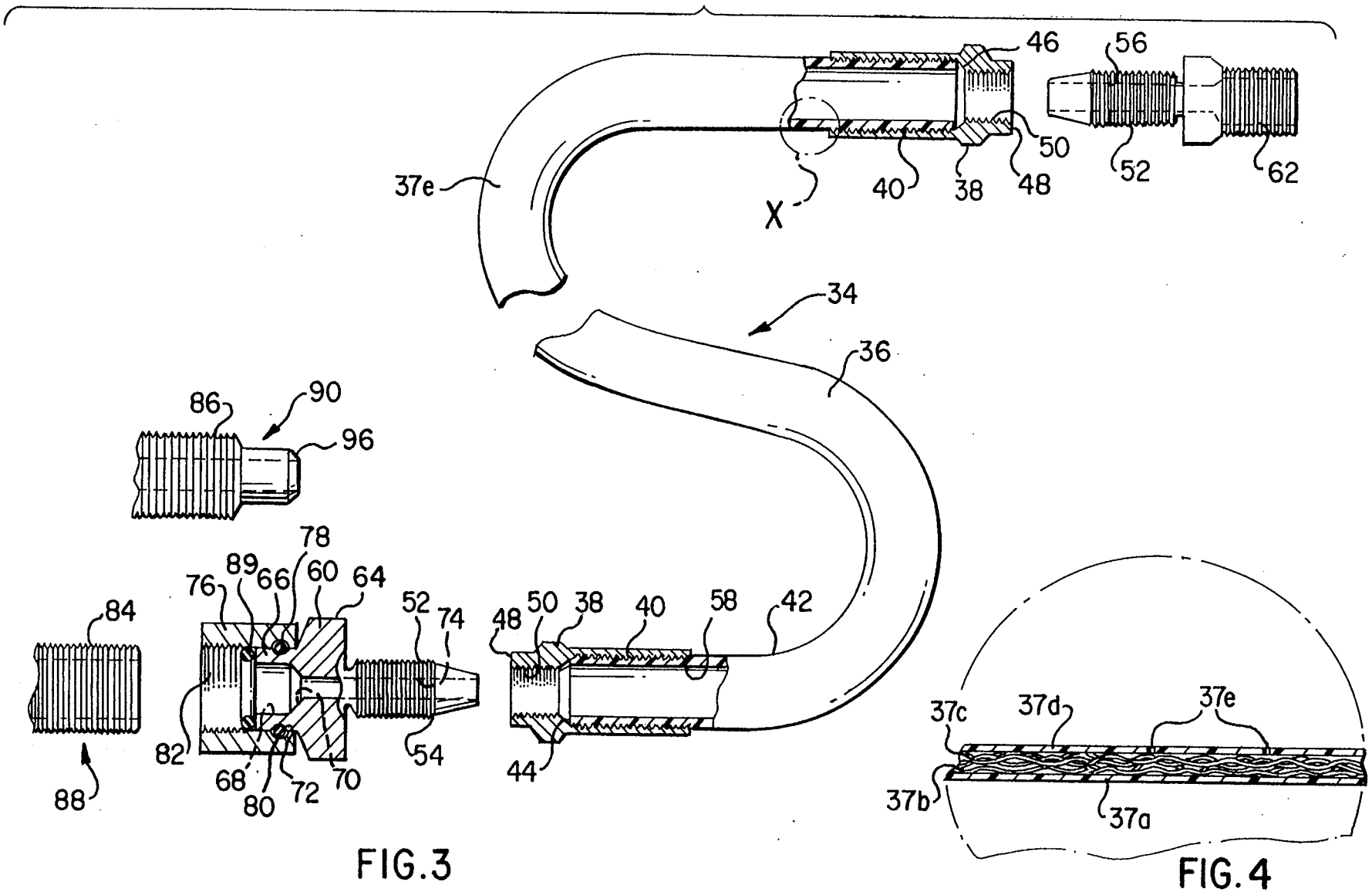
FIG. 3 is an exploded side view, partly sectional, of a hose assembly of this invention, including two types of cylinder couplings to which a cylinder-hose coupling of the hose assembly of this invention can attach.
FIG. 4 is a segmented portion of an enlarged view of a portion of the hose designated as X in FIG. 3.

The hose assemblies 34 and 34' are shown in more detail in FIGS. 2 and 3. Since the hose assemblies 34 and 34' are virtually identical in structure, although one may be longer than the other, only one is depicted in FIGS. 2 and 3.

The hose assembly 34 comprises a thermo-plastic hose 36 which is constructed of an inner nylon or dacron, for example, tube 37*a* reinforced by two layers 37*b* and *c* of woven synthetic fibers. The hose is then covered by a black perforated polyurethane cover tube 37*d*, which is perforated at 37*e* to allow escape of gases at pressures greater than 3000 psi. In a preferred embodiment, the internal diameter of the hose is ¼ inch and the external diameter is around ½ inch.

Screwed to each end of the hose 36 is a brass socket 38 having self-tapping female hose threads 40 at a large-end portion thereof with a diameter of approximately ½ inch. These hose threads are screwed onto an outer surface 42 of the hose 36 at opposite ends 44 and 46 thereof. Each socket 38 includes near an outer, small end 48 thereof female nipple threads 50 with a smaller diameter than the diameter of the hose threads 40. The nipple threads 50 respectively engage male threads 52 on cylinder and raft nipples 54 and 56 which respectively screw into the nipple threads 50 and into an internal surface 58 of the hose 36, and thereby releasibly clamp a hose wall between the cylinder and raft nipples 54 and 56 and their respective sockets 38. Thus, releasable sealing engagement is established between each of the cylinder and raft nipples 54 and 56 and the hose 36.

The cylinder nipple 54 is machined as a one-piece female cylinder fitting with a cylinder-hose coupling 60 while the raft nipple is molded as a one-piece male coupling fitting with a raft-hose coupling 62. These integrated members are machined of one piece of brass. The raft-hose coupling 62 has male threads on an outer surface thereof to engage a swivel nut (not shown) of the raft inlet cock 32 or 32'.

The cylinder-hose coupling 60 is a specially constructed member comprising a hexagonally shaped wrench pad 64 and a mounting cylinder 66. The mounting cylinder 66 defines a coupling seat cavity 68, having an inner coupling seat 70 at an inner end thereof, and a retainer-pin groove 72 about an exterior surface thereof. The coupling seat cavity 68 communicates with a nipple passage 74 to extend completely through the integrated female cylinder fitting 54/60. The cylinder-hose coupling 60 is rotatably attached to a swivel nut 76 by means of a circular retainer pin 78 positioned in the retainer-pin groove 72 and a retainer-pin groove 80 in an interior surface of the swivel nut 76 through a hole (not shown) in a wall of the swivel nut 76. The swivel nut 76 has female threads 82 in a cavity thereof for receiving external threads 84 or 86 of either an old-type cylinder coupling 88 or a new-type cylinder coupling 90. A resilient 0-ring 89 is mounted in a cavity of the swivel nut 76 at an outer coupling seat of the cylinder-hose coupling 60.

In operation, a hose assembly 34, or 34' is constructed by cutting a desired length of hose 36, mounting a socket 38 on each end thereof and screwing a cylinder nipple 54 into one of these sockets and a raft nipple 56 into the other socket to thereby crimp the hose wall at the ends of the hose 36 between the sockets 38 and the respective cylinder and raft nipples 54 and 56. The raft hose 36 is then attached to one of the raft inlet cocks 32, 32' by engaging the male threads 62 on the raft-hose-coupling 62 (which is made as one brass part with the raft nipple 56) with female threads of a swivel nut (not shown) on the inlet cock. The cylinder-hose coupling 60 is attached to either an old-type cylinder coupling 88 or to a new-type cylinder coupling 90 by rotating the swivel nut 76 at the circular retainer pin 78 so that the female threads 82 of the swivel nut 76 engage external threads 84 or 86 of the old or new type cylinder coupling 88 or 90. In this respect, if the swivel nut 76 is screwed onto an old-type cylinder coupling 88, then the old-type cylinder coupling seats with the cylinder-hose coupling at the resilient O-ring on the external seat so as to achieve a resilient non-metal-to-metal seal thereat. On the other hand, if the swivel nut 76 is screwed onto the new-type cylinder coupling 90, a surface 96 thereof makes metal-to-metal sealing contact with the internal coupling seat 70.

It will appreciated by those of ordinary skill in the art that the hose assembly for use in this invention, with the thermo-plastic hose 36 and the fittings at the ends thereof, is highly flexible but yet will not cause damage to an inflatable raft. Further, even though the sockets 38 are not covered by the outer cover tube 37*d* (the sockets 38 are applied to the exterior of the outer cover), they do not damage surrounding parts, because they do not have sharp edges. Still further, the hose assembly for use with this invention is smaller than metal braided hoses of the prior art and is more easily fitted into the clamshell container 14.

More importantly, the hose assembly 34 is designed to handle the severe air pressure necessary much more effectively than did prior-art devices. Under pressure, air or any other gas has tendency to permeate through a hose liner (core) and cause the hose cover to swell. If the gas cannot escape, it may cause the hose to burst or the gas will migrate to the ends of the hose and may cause the fittings to blow off.

The thermo-plastic hose 36 of this invention is constructed with a "pricked" (porous) or perforated outer surface that allows escaping air to pass through the cover without damage. The prior-art construction, which incorporated a teflon hose liner with braided metal cover, or reinforcement, did not offer this benefit and was therefore prone to failure.

Also, the hose assembly of this invention is less expensive to construct than prior-art metal-braided hose assemblies, and parts thereof can be replaced as necessary. Also, because the hose assembly of this invention offers less metal-to-metal contact than did prior-art hose assemblies for life raft storage and inflation systems, it has been found that it lasts at least twice as long as the prior-art hose assemblies. Also, the fittings for the hose assembly of this invention are reusable when the hoses are replaced. Similarly, a hose assembly for use in this invention can be easily worked on without being replaced.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

We claim:

1. A life raft storage and inflation system comprising:

a clamshell life-raft canister having at least two separable parts and forming a canister cavity therein;

a deflated raft stored in said canister;

a compressed-gas cylinder stored in said canister, said compressed-gas cylinder including a selectively activated nozzle for being activated to release air from said compress-gas cylinder;

an activating means for activating said nozzle to release said compressed gas;

a hose assembly for being coupled to said compressed-gas-cylinder selectively-activated nozzle and extending therefrom to an inlet cock of said deflated life raft, said hose assembly comprising:

a hose formed of a fiber-reinforced, thermoplastic hose wall; cylinder and raft sockets having self-tapping female threads for being screwed onto an outer surface of said hose at opposite ends thereof, each of said sockets having smaller-diameter female nipple threads positioned at an outer end thereof beyond a respective end of the hose; cylinder and raft nipples having male threads thereon for respectively mating with the smaller-diameter, female, nipple threads of respective cylinder surface of the hose for thereby sealing the hose wall between the nipples and the sockets, each of said cylinder and raft nipples being respectively made as one piece with one of a cylinder and raft coupling for respectively coupling to one of said cylinder nozzle and said inlet cock;

wherein said cylinder coupling is tubularly shaped to define a coupling-seat cavity in a bore thereof with a metallic inner seat therein for sealing with a first type of cylinder nipple and wherein said cylinder coupling is surrounded by a swivel nut mounted on an outer surface of said tubularly-shaped cylinder coupling by means of a circular retainer pin to swivel thereon and said cylinder coupling defines an external seat at an outer end thereof with an O-ring thereon held laterally in place by said swivel nut for sealing with second type of cylinder nipple.

2. A life raft storage and inflation system as in claim 1 wherein an inner tube of said hose is constructed of nylon which is fiber-reinforced by fibers extending thereabout, and wherein is further included a perforated tube extending about, and covering said fibers.

* * * * *